United States Patent [19]

Perobelli et al.

[11] Patent Number: 4,977,726

[45] Date of Patent: Dec. 18, 1990

[54] CONTINUOUS SIGNATURE STACKER MACHINE PROVIDED WITH SPECIAL DEVICE FOR TRANSVERSELY EJECTING THE ASSEMBLED PACKAGE

[75] Inventors: Aldo Perobelli; Giorgio Pessina, both of Cusano Milanino, Italy

[73] Assignee: O.M.G. di Diorgio Pessina e Aldo Perobelli S.n.c., Milan, Italy

[21] Appl. No.: 334,091

[22] Filed: Apr. 5, 1989

[30] Foreign Application Priority Data

Apr. 18, 1988 [IT] Italy ..... 20239 A/88

[51] Int. Cl.[5] ..... B65B 35/50; B65B 63/02

[52] U.S. Cl. ..... 53/542; 53/529

[58] Field of Search ..... 53/540, 542, 443, 438, 53/528, 529, 531, 582

[56] References Cited

U.S. PATENT DOCUMENTS

| | | | |
|---|---|---|---|
| 3,562,775 | 2/1971 | Mullins | 53/542 X |
| 4,074,508 | 2/1978 | Reid | 53/542 X |
| 4,141,193 | 2/1979 | Joa | 53/542 X |
| 4,332,124 | 6/1982 | Jaton | 53/542 X |
| 4,879,862 | 11/1989 | Nolte et al. | 53/542 X |

*Primary Examiner*—James F. Coan

*Attorney, Agent, or Firm*—Dann, Dorfman, Herrell and Skillman

[57] ABSTRACT

A continuous signature stacker machine is provided with a transversely operating assembled package ejecting device. The stacker includes a platform onto which individual signatures are sequentially fed on edge to form a stack of predetermined length and a slide member against which the formed stack is pushed. The slide member is moved by a pair of chains slowly in one direction as a stack is formed and rapidly in the opposite direction to a position for forming a new stack after the formed stack is removed. The formed stack is manually or automatically pressed and strapped.

8 Claims, 7 Drawing Sheets

CONTINUOUS SIGNATURE STACKER MACHINE PROVIDED WITH SPECIAL DEVICE FOR TRANSVERSELY EJECTING THE ASSEMBLED PACKAGE

The subject of this invention is a continuous signature stacker machine, provided with a special device for transversely ejecting the assembled package. As it is already known, the signatures coming out of folding machines are usually collected into packages in order to be then transferred to other bookbindery machines.

It is also known that said collecting operation is conventionally performed by means of special signature stacker machines, which are in general operated to set a certain number of signatures adjacent to each other, in order to form a "package", wherefrom said signatures are picked up manually in small parcels. In any case the machines presently used for said purpose are rather complicated as far as their structure is concerned, and they are not always geared to continuous operation.

Furthermore, said conventional machines, usually require important modification and setup operations for any variation of the dimensions of the signatures to be stacked.

An object of this invention is to overcome the previously mentioned drawbacks, by providing a signature stacker machine which doesn't require any interruption of operations during the process of picking up the assembled package.

Within the scope of the task mentioned above, a particular object of this invention is to provide a signature stacker machine which is very reliable and of a simple construction.

A further object of this invention is to provide a signature stacker machine which allows different size signatures to be handled, with minimum adjustments.

The above task, as well as the objects mentioned above, and further objects which might become more apparent in the following, are achieved in a signature stacker machine according to this invention, characterized in that it substantially includes a platform, whereon the individual signatures are sequentially fed resting on the edge thereof, in order to progressively assemble a predetermined length package which is then transferred across the platform, in a transverse direction, by means of a special ejecting device, which is adapted to transfer said package directly on the platform of a further machine (for instance a strap applying machine); in particular, the package of signatures being assembled is opposed, at the forward moving front thereof, by a slide member, driven by a pair of chains and automatically repositionable, after the package has been formed and transferred, to an opposition location relative to a new package being formed.

Further features and advantages of the signature stacker machine which makes the subject of this Invention Patent will be better understood from the following description of a preferred embodiment of the subject machine shown, for purely exemplary and non limiting purposes, in the Figures of the attached drawings, wherein.

Figure 1:
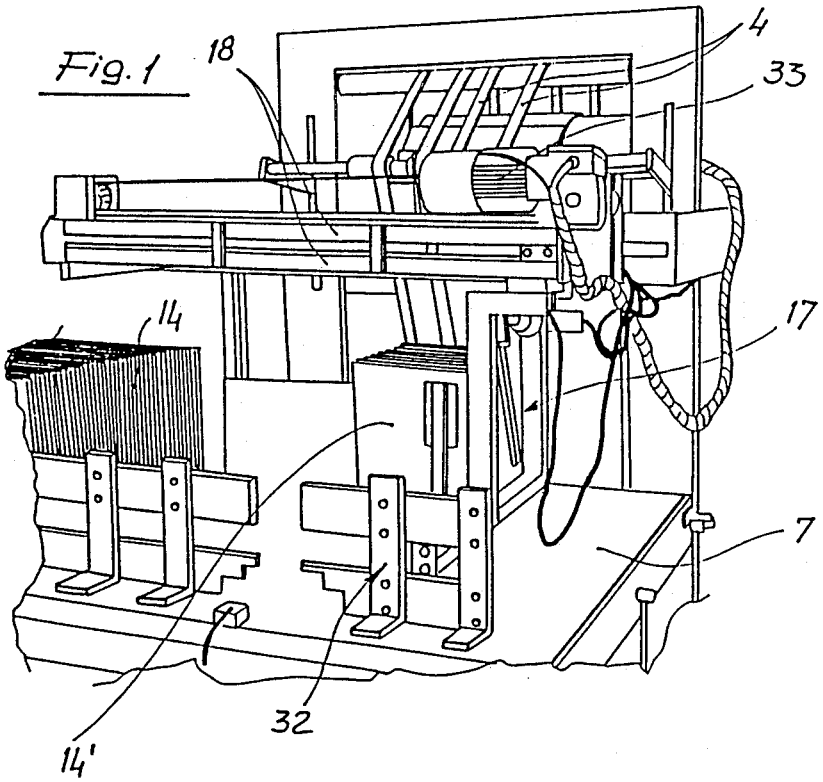
FIG. 1 shows a schematic perspective view of the subject machine.
Figure 2:
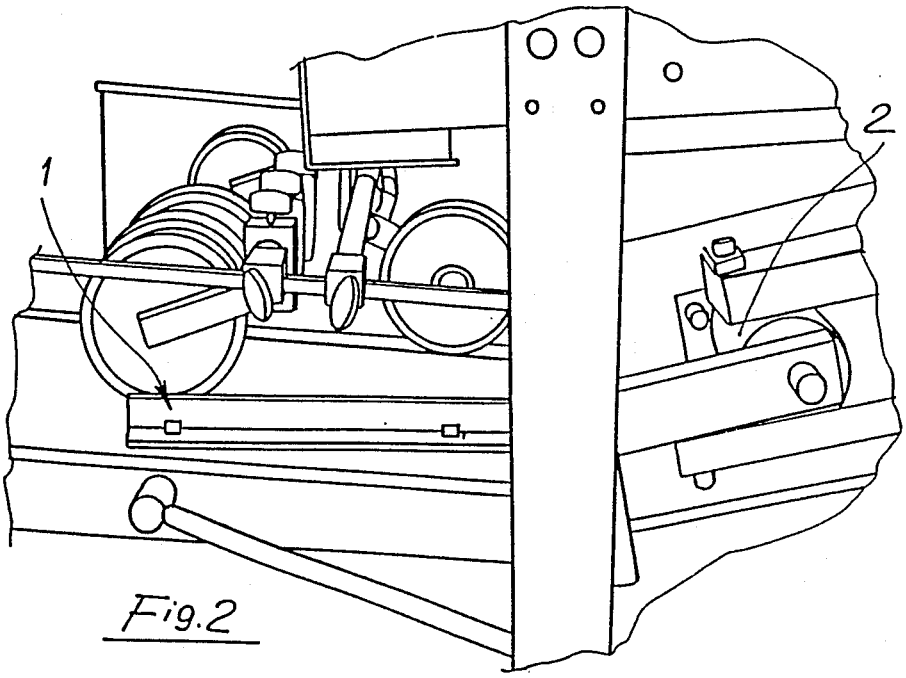
FIGS. 2 and 3 show a pair of devices provided in sequence on the machine, and comprising an actual part of the machine.
Figure 3:
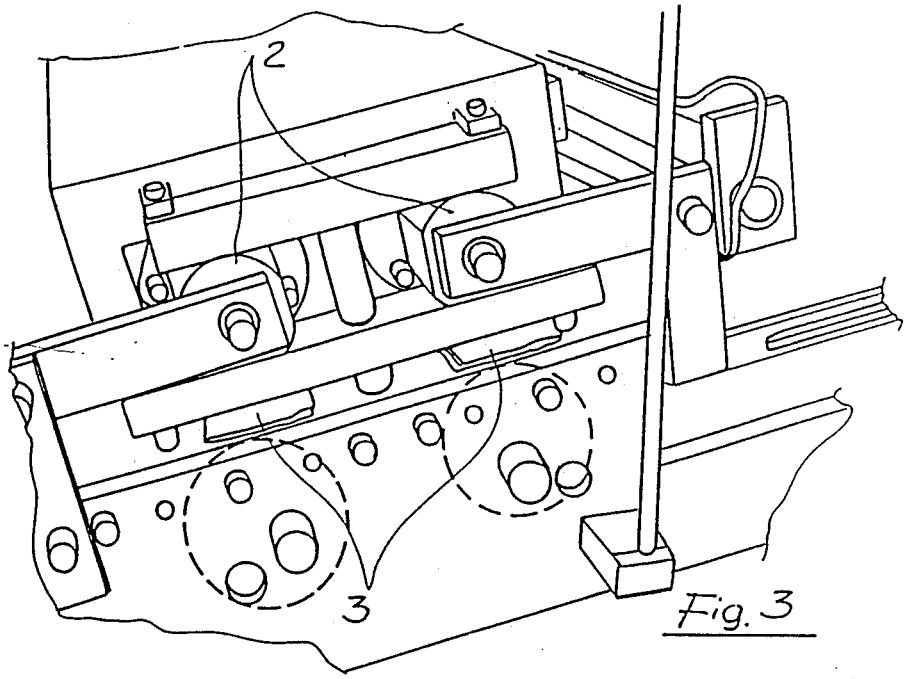
Figure 4:
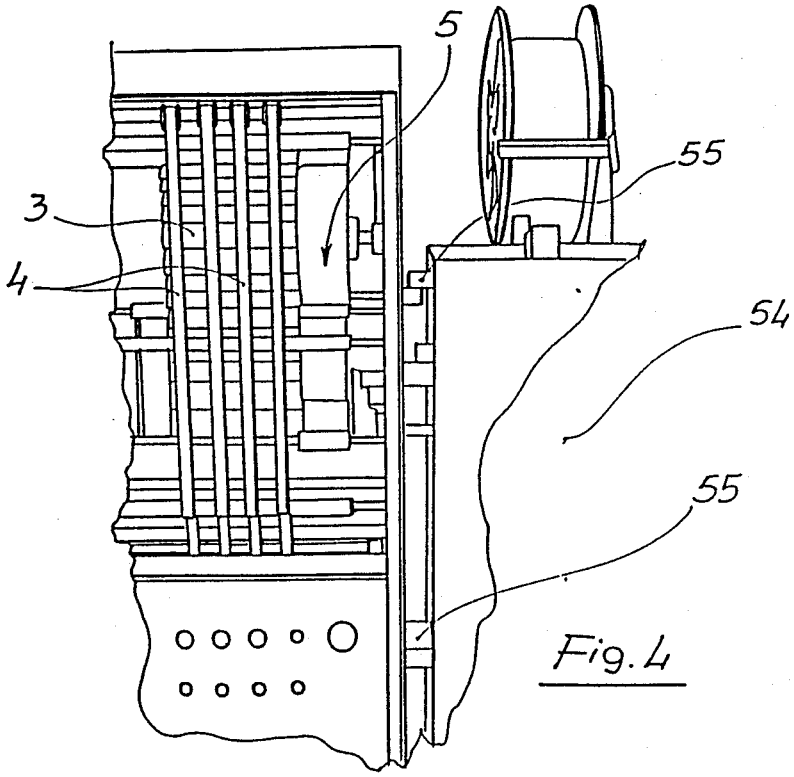
FIG. 4 shows a rear view of the subject machine, a strap applying machine being located on the side thereof, and suitably connected thereto.
Figure 5:
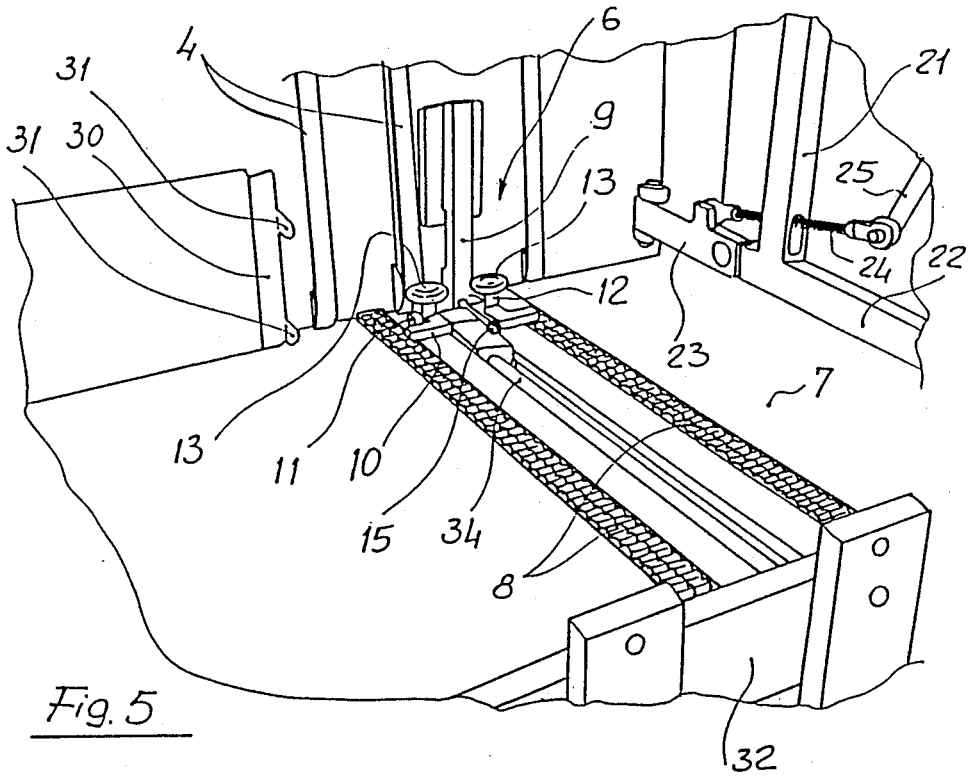
FIG. 5 shows the platform of the subject stacker machine.
Figure 6:
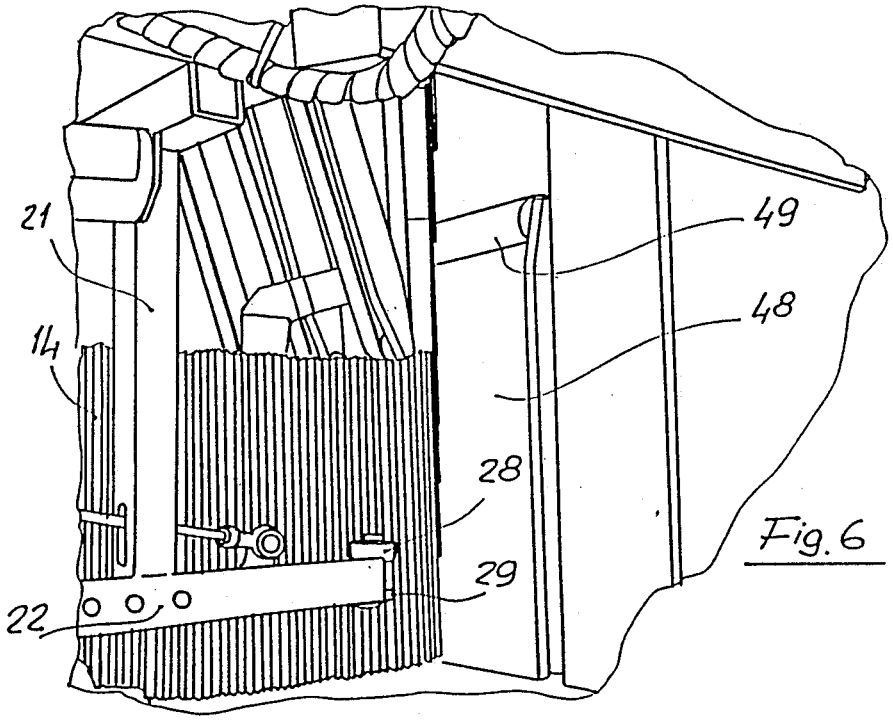
FIG. 6 shows a step in the formation of the package of signatures.
Figure 7:
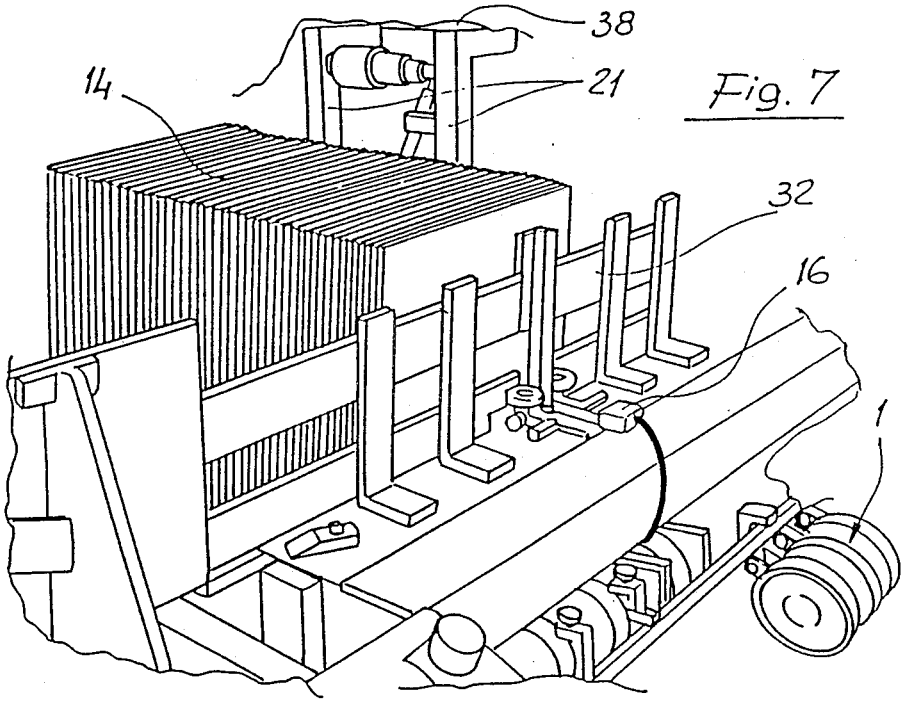
FIGS. 7, 8 and 9 show schematically the ejection sequence of said package.

Referring now in particular to the reference numbers of the various Figures of the attached drawings, the subject signature stacker machine includes a roller feeder, shown in general at (1), with a press station provided downstream thereof, said station comprising a plurality of mutually opposed rollers (2).

Said mutually opposed rollers are provided to subject the signatures (3) already folded and by un upstream folding machine, to a suitable pressure for the purpose of ejecting air from said signatures flattening them further, in order to improve the folding situation thereof.

Said signatures, processed as above, are subsequently picked up by a belt system (4) which is adapted to give them a fish scale like arrangement and to forward them vertically upwards along a stretch 5.

From the upper end thereof, said signatures are transferred downwards (still under the action of the belt system mentioned above) while resting on the edges thereof, and they slide along the vertically downwards stretch, whereupon they get arranged in a vertical position along a sliding platform (7).

In the central area of said platform chains (8) are provided, sliding at a certain distance apart, and winding around driving sprockets and idle sprockets. Concerning the latter it should be pointed out that said chains are slightly projecting relative to the platform, and they move forward those signatures which, under the action of gravity, come to rest on the top portion of their links.

Futhermore, said pairs of chains drive the forward motion of a slide member (9), hooking up to one of their links by means of cogs arranged underneath a pair of small L-shaped arms, shown at (10), pivoted at (11) around a horizontal axis, at the base of said slide member.

In addition, said small arms are provided, on the vertical of their pivoting axis, with a further small upwards extending arm (12) which carries, at the top thereof, a small coaxial idle wheel (13).

A pressure action is established on said pairs of small wheels by the various signatures being deposited on the platform, which gradually form a package (14) having a progressively increasing thickness.

In particular said package, by pushing on the small wheels mentioned above, causes a slight downward rotation of small arms (10) whereby the lower cogs thereof get into meshing engagement with a corresponding number of links of chain (8).

The meshing engagement of said small cogs can be obtained as well by means of an electromagnet, or of a small pneumatic cylinder or the like.

Slide member (9) is provided, at the front side thereof, with an adjustable screw (15) which, once said slide member has reached a predetermined limit position, is controlled to actuate a microswitch (16) which, in turn, actuates a package ejection device, indicated in general at (17).

Said ejecting device, is generally supported by a moving frame, adjustable on a stationary frame provided for the purpose. Said design arrangement allows the package to be ejected at both sides of the machine, without having to resort to complicated adjustment and control operations.

Furthermore, said design approach eliminates any projection out of the machine outline, both during manual withdrawal of the signatures and during automatic ejection thereof.

According to a preferred embodiment, the ejecting device is comprised of sliding rails (18) arranged transversely relative to said pair of chains (8), and adapted to form translation guides or seats for pairs of small diameter rollers (19).

The latter support a carriage (20), which in turn carries two vertical arms shown at (21), connected by a lower horizontal cross member (22) which is in turn provided, at the ends thereof, with corresponding pivoting arms (23).

Of said pivoting arms, the one facing towards the inner area of the platform is linked, by means of a first rod (24), to a lever (25), whose power receiving end is driven by a second rod (26) comprising the reciprocating armature of an electromagnet (27), or by an equivalent member.

Furthermore, the arm mentioned above is provided, at the free end thereof, with at least a small roller (28) adapted to slide with the lowest possible friction, against the signatures, at the moment when the package is being ejected.

Underneath said small roller there is provided, at both sides of the ejecting device, a small plate (29) whose function is to contain the package to be ejected, separating the same from the various other signatures which are meant to form a following package (14').

On the side of said platform inner chain there is provided a vertically projecting member (30) carrying, at different heights, two or more separator blades (31) arranged stepwise at the package ejection side.

More particularly, said projecting member which is provided as well with a package holding plate, is fastened to the machine upper platform, and is comprised of mutually telescoped members. Said feature substantially makes member (30) constantly adjustable close to a side of the package, regardless of the size of the latter; furthermore, it allows said adjusting operation to be performed keeping to a minimum the room between the stacker machine and the following package processing station. In practice, said blades prevent an incorrect ejection of the signatures located in an intermediate position between package (14) to be ejected and package (14') being newly collected on platform (7).

Of course, at the front end of the latter there is provided a properly adjustable guide or barrier member (32) adapted to retain the package of signatures, until the moment it is ejected.

Said ejecting device (17) is suitably driven by a geared motor (33), by means of cogged belts, chains or equivalent transmission means.

In particular, said transmission belts or chains are fastened, at one end thereof, to a connection point whereat a towing action is applied to carriage (20). Obviously, the ejecting device mentioned above may be driven, in alternative, also by pneumatic cylinders, or by other functionally similar members which, in any case, are adapted to provide the traverse movement of said carriage and of arms (21) carried thereby.

Figure 8:
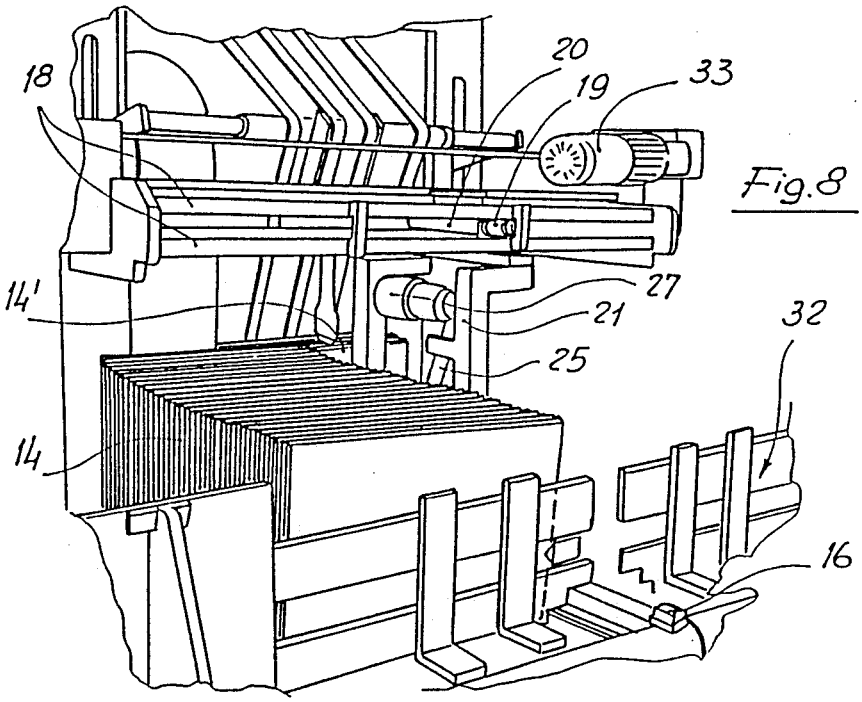
Figure 9:
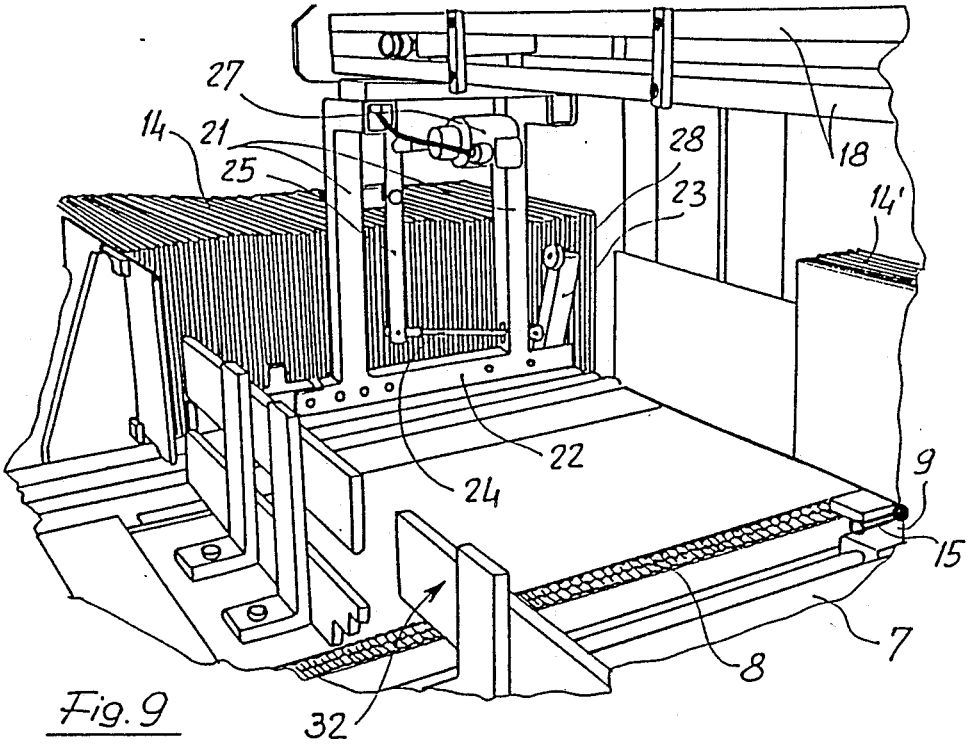
Figure 10:
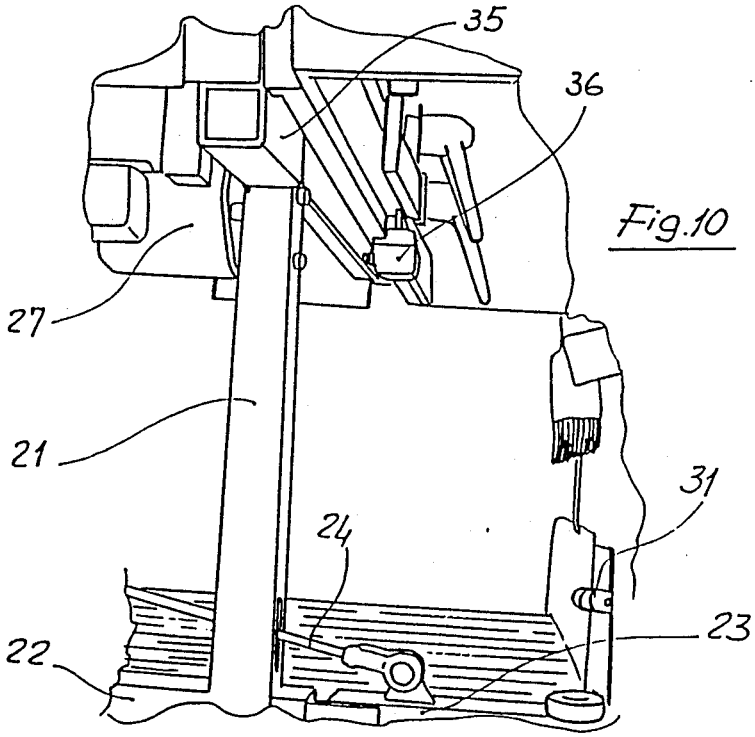
FIG. 10 shows a mechanism adapted to interrupt, in a predetermined position, the motion of the signature package ejecting device.
Figure 11:
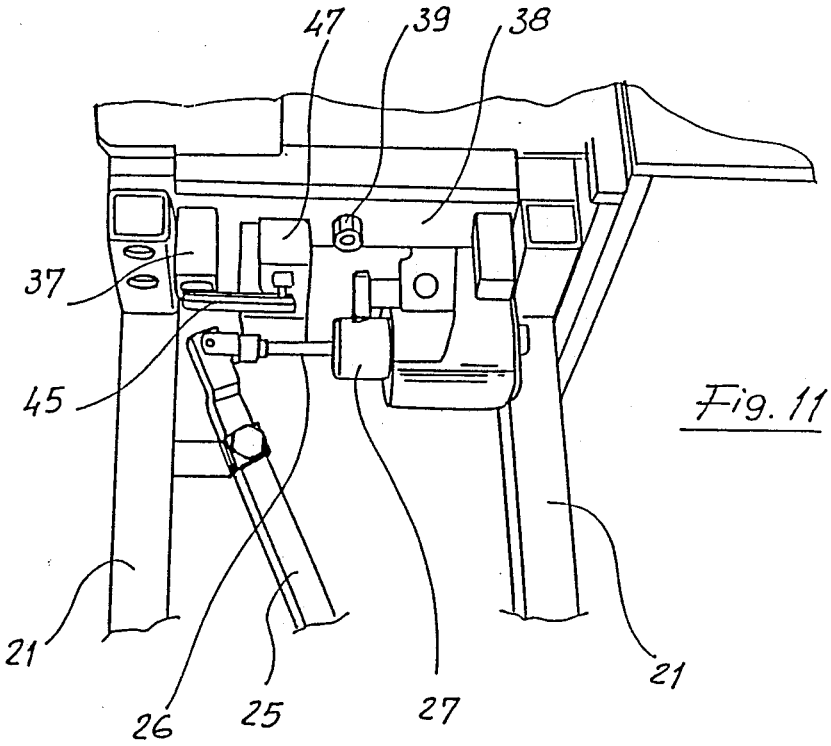
FIGS. 11 and 12 show in a perspective view, and in a schematic respectively, a mechanism adapted to block said ejecting device if the same is not correctly positioned, relative to the signatures placed side by side, or in the case some unpredictable problems take place during the translation of said device.
Figure 12:
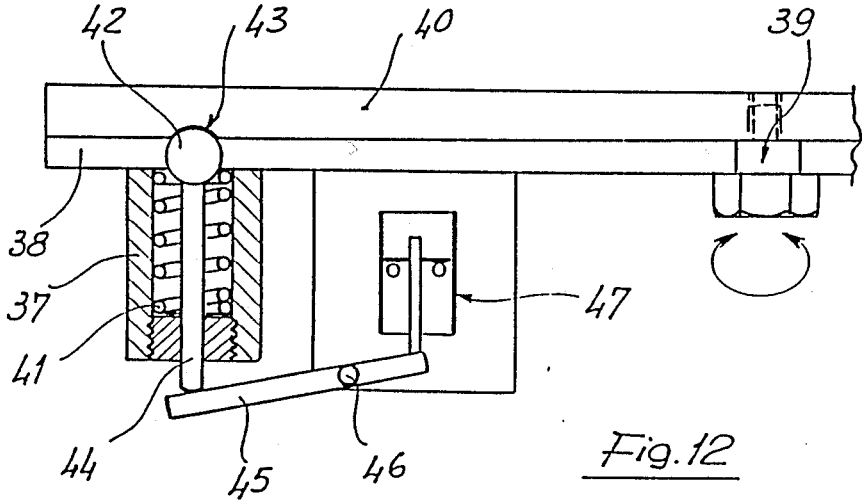
Figure 13:
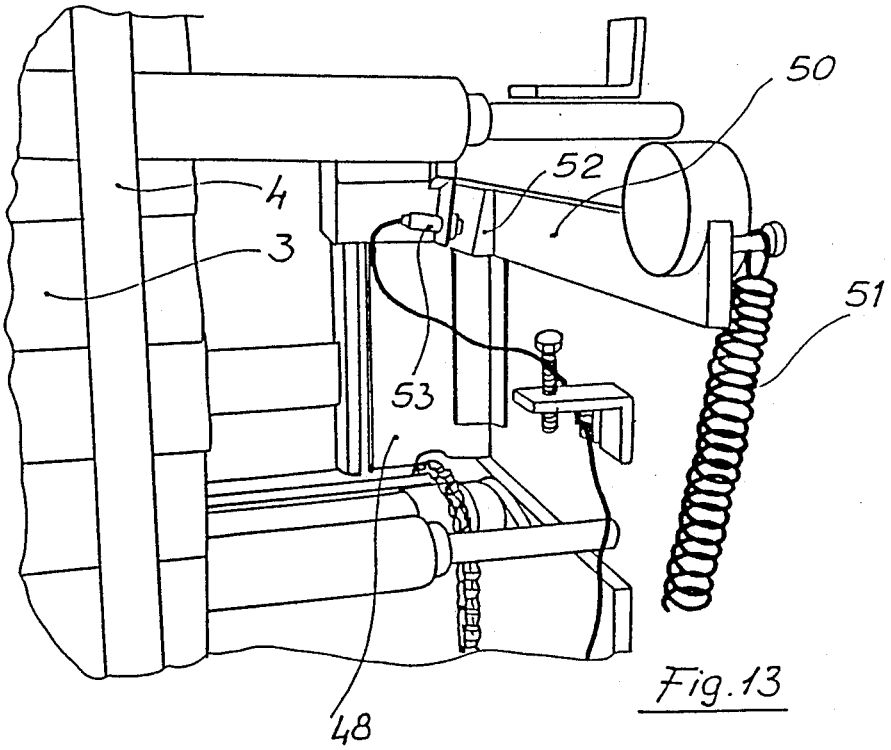
FIG. 13 shows an apparatus adapted to control the motion of the driving chains for the slide member and for the signatures.
Figure 14:
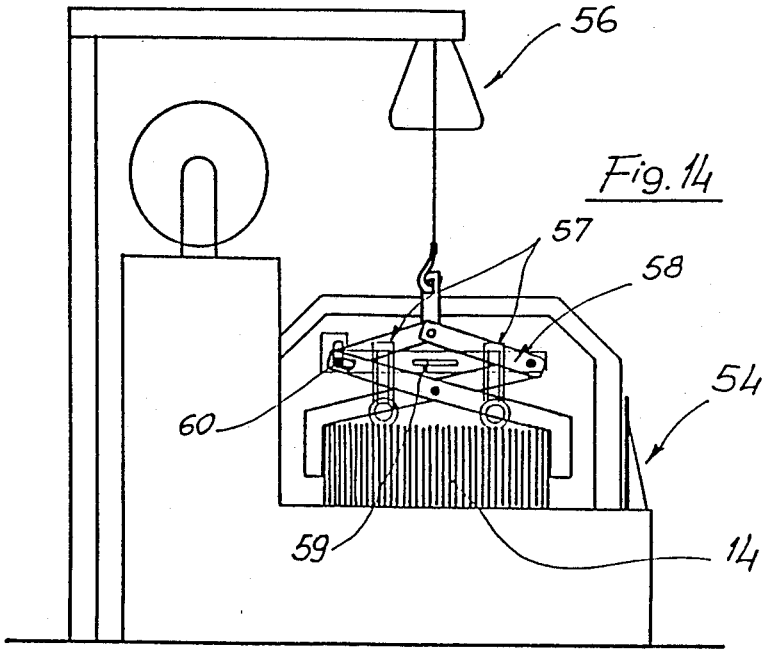
FIG. 14 shows schematically a withdrawal device for a formed and strapped package.

It should be pointed out as well that said ejecting device stops, after a predetermined stroke (see FIG. 8), so that, while a part of a package is being ejected, a retaining action is maintained upon the package being formed, while slide member (9) is coming back, for retaining purposes of the forming package.

Said slide member return stroke is substantially made possible in that the cogs hooking the latter to chains (8) automatically disengage therefrom since there vanishes the pressure applied, on the upper part of said slide member, by said package of signatures, said disengagement being also possibly controlled by an electro-magnet, or by a cylinder, or by means of a cam slide.

Said disengagement enables the slide member to move back, along said slide member guiding rail (34), under the return action provided, through a cable, by a weight subjected to the force of gravity, or by a motor driven return arrangement.

For stopping carriage (20) and the ejecting device carried thereby, there is provided a small plate (35), projecting out from both vertical arms (21) and adapted to come into engagement with a microswitch (36) located in a proper position on guide rails (18).

In practice, since in general in the stacker apparatus the signatures are stacked at the central position of the stacking section, the adjustable frame carrying the ejecting member will be positioned close to an end of the package being formed.

Once the package has been completed, or in any case it is located close to barrier (32), a sensor which will be described more particularly in the following, speeds up the package forwarding chains, in order to relieve the pressure of the packaged signatures and to assist both the stacking up of the incoming signatures and the proper separation of the signatures proceeding to ejection from the ones remaining on the stacker, as well as the package ejecting operation.

In particular, the package ejecting operation takes place after the above mentioned sensor (16) has been actuated, while the action of the chain speed-up sensor can be disabled or enabled according to need.

At the end of the ejection stroke, the package will be advantageously positioned in a proper way above a pressing and strap applying station, or on a manually processing station.

Said result is attainable in that the ejecting member carrying frame can slide on the stationary frame, so that for any different size signatures, the package, at the end of the ejection operation, and thereby at the moment of the binding or strap applying operation, is always located in an intermediate position obtained automatically through the proper amount of sliding of the frame.

Based on the above contrivance, it is possible to keep a constant length of the ejecting member stroke while adjusting the ejecting member carrying frame in parallel to the ejecting stroke, in order to perform unrestrained ejection from one side or the other, while keeping the self-centered package position relative to the processing station which follows the package formation stage. Said convenient result can substantially be attsined by providing an adjustable ejecting member carrying frame, having fixed positions.

It should also be pointed out that an ejecting device embodied as described above can be applied for different type stacker apparatus as well, like for instance cardboard box stacker apparatus, or stacker apparatus for brochures, leaflets, books and so on.

On the subject machine there is further provided a device adapted to stop the machine in case, for any reason, a variation of the ejecting device orientation takes place relative to the vertical plane.

Said device comprises a tube shaped body (37) positioned at right angles relative to ejecting device upper cross member (38) which is hingedly connected, on the average at pivot axis (39), to base (40) of the carriage mentioned above.

In particular, within said tube shaped body there is received a spring (41) supporting a small ball (42) which projects through an opening provided for that purpose through cross member (38), in order to engage within a matching cavity (43) provided in the carriage base. Said small ball is provided with an extention rod (44) projecting through a suitable opening in the base of tubular member (37) and contacting, at the end thereof, a small lever (45).

The latter pivots at (46) and it is resiliently loaded through a coil spring or the like, or else by the plunger of a microswitch (47), and it is adapted to control said microswitch which is provided in turn to control the power supply to said geared motor assembly (33), or any other suitable driving means for carriage (20).

In practice, any undesirable rotation of the ejecting device around axis (39) results in a pressure being applied on small ball (42) and thereby on small lever (45), whereby said carriage is stopped.

Said ejecting device, once it has unloaded a package of signatures starts a return stroke and in said conditions pivoting arm (23) is recalled upwards by electro-magnet (27) so that it does not interfere with forming package (14').

Concerning the above, it should be pointed out that said pivoted rotatable arm (23) might be replaced as well by an arm which is either able to move back through a telescoping arrangement, or to rotate on the vertical plane.

As an alternative, an arrangement may also be provided whereby the whole ejecting carriage support frame can be moved back relative to the package forwarding direction. In addition, it should be pointed out that the driving device for both pairs of chains (8) is driven by a gear motor unit whose rotating speed is controlled manually or in combination with the position of a vertical plane (48) provided at the location where the plurality of signatures move downwards.

Said plane is hingedly supported at the top side thereof, at horizontal axis (49), and it is connected with naturally downward biased lever (50), provided in a position approximately at right angles relative to said plane.

Said lever is in turn preferably provided with a projection forming a hooking point for the end of a spring (51) whose lower end is resiliently tied down to a suitable fastening member integral with the machine frame. Said lever is further provided with a projecting chute shaped portion, shown at (52), where an electronic sensor (53) is positioned, the latter sensing the longer or shorter distance from said projecting portion, which is of course related to the different lever positions.

Substantially, said lever tends to rise or to lower according to the higher or lower pressure of the pack of signatures on vertical plane (48), thereby increasing or decreasing, accordingly, the speed of said geared motor unit, through the sensor mentioned above. Said sensor may for instance comprise a voltage divider, suitably controlled by the oscillations of vertical plane (48).

More particularly, when the signatures are conveyed on platform (7), vertical plane (48), performing as a feeler, tends to move towards the machine rear side and in so doing it varies in the proper direction the speed of the forwarding chains mentioned above.

It should also be emphasized that the stroke length of the ejecting device supporting carriage is suitably adjustable, whereby a perfect ejection of the signatures is provided, for any different size thereof.

Said signatures, after having been ejected, land on the platform of a strap applying machine (54) known per se, where the packages are tied up by means of straps, webs, ropes and so on.

In particular, provision is made so that said strap applying machine is connected, at the rear edge of the sides thereof, to the corresponding side of the subject machine, by means of hinged connections (55).

In practice, said feature enables a suitable hoisting and transferring apparatus generally shown at (56), to be positioned directly in contact with said side-by-side paired machines, with a swinging arrangement, said apparatus being adapted to pick up signature packages from the strap applying machine and to load them on pallets or like means, according to need.

More precisely, said hoisting apparatus is provided with gravity actuated tongs (which are simple and cost effective concerning both construction and handling), carrying, on the pantograph arms thereof two adjustable levers (57), having rollers associated with one end thereof.

The latter, when touching the package of paper, make it possible to adjust the height at which the tongs come into engagement with the package and the sliding of the pantograph arms in contact with the latter when the package is automatically disengaged from the tongs once, in its downwards travel, it is laid down where desired.

On said tongs there is provided a bar pivoted on the pantograph levers, at the one end, while at the other end of lever (58) there is provided an L-shaped slot. When the pin provided on one of the pantograph arms comes into engagement with the highest position in said slot, the above arrangement allows the tongs to stay in the open position. Obviously, said condition takes place in that the weight of the pantograph arms acts on the upper part of the slot, providing sufficient pressure to prevent the pantograph levers from getting closer to each other, and therefore to close.

Vice versa, when the rollers of arms (57) bear on the package, the pressure of the pantograph arms on the upper end of the L-shaped slot goes down to zero, whereby lever (58) may be lifted by means of handle (59) integral therewith. At this point the pantograph tongs can enclose the package if the hoist is actuated for lifting, in that pin (60) may slide in the lower portion of the L-shaped slot.

Actuation of lever (58) may be performed also automatically, by means of a pneumatic cylinder, an electromagnet, or any other functionally equivalent device. Concerning the above it should be pointed out that, the heavier the package to be lifted, the stronger is the closure force.

Furthermore, said handle (59) is advantageously provided both for actuating lever (58) and for displacing the tongs on the swinging hoist and for correctly laying the package on a pallet, on a platform, or anywhere it is desired.

When the package, during the lowering step thereof, comes into engagement with the desired support plane, rollers (57) come to rest on said package, the pantograph levers slide outwards causing the tongs to open, lever (58) goes into engagement with the top portion of the L-shaped slot, and pin (60) integral with the pantograph lever, causes the automatic opening and keeps said tongs in the open position.

From what has been described above, and from observation of the Figures of the attached drawing, there distinctly shows the higher functionality and usage convenience characterizing the signature stacker machine subject of this Invention Patent.

It should be understood that said machine has been described and illustrated above for purely exemplary and non limiting purposes, with the only purpose to prove the practical feasability and the general features of this Invention, whereby to the same there may be made all those variations and modifications occurring to those skilled in the art, and included in the scope of the inventive concepts described above.

What we claim is:

1. Signature stacker machine comprising a platform (7) wherein the signatures (3) are transferred forming progressively vertical signature packages (14,14') fed along said platform (7); a slide member (9) moved by two parallel chains (8) along said platform (7) pushed by the forming signature package (14); an ejecting device (17) adapted for transferring along a path transversely to said platform (7) a signature package (14) to a predetermined position (54) where a processing machine (56) is located, characterized in that said chains (8) project slightly above said platform (7) moving the signatures along the platform (7) and in that said slide member (9) pressed by the signatures is pivoted to two arms (10), each engaging one of said chains (8), when the signatures press against said slide member (9) and both arms (10) being free from said chains (8) when there is not pressure of the signatures against such slide member (9) during the transfer of the package (14) actuated by said ejecting device (17).

2. Signature stacker machine comprising a platform (7) wherein the signatures (3) are transferred forming progressively vertical signature packages (14,14') fed along said platform (7); a slide member (9) moved by moving means (8) along said platform (7) pushed by the forming signature package (14), an ejecting device (17) adapted for transferring along a path transversely to said platform (7) a signature package (14) to a predetermined position (54) where a processing machine (56) is located, characterized in that stop means (35,36) are provided along said transverse path located in an intermediate position before said processing machine (56) and adapted to stop temporarily said ejecting device (17) against a new advancing signature package (14') for a time necessary for said slide member (9) to return along said platform (7) against said new advancing signature package (14').

3. Signature stacker of claim 2, wherein means are provided to move said ejecting device (17) from said platform (7) towards said processing machine (56) and to return back to said platform (7), said ejecting device (17) comprising an arm (23) and means are provided to locate said arm (23) in a horizontal position during the ejecting movement towards said processing machine (56) and in a vertical position during the return to the platform (7), for avoiding to interfere with a new forming advancing package (14').

4. Signature stacker of claim 2, wherein a plate (30) with separator blades (31) is adapted to be located in intermediated position between said platform (7) and said processing machine (56) parallel to the ejecting path, said blades (31) being positioned against the first signatures forming the new package (14'), to avoid an incorrect ejection of the signatures laying between the package (14) to be ejected and the new package (14').

5. Signature stacker of claim 2, wherein stop means (42–44) are provided to stop the operation of the stacker machine in response to the position of said ejecting device (17) diverging from a vertical plane perpendicular to said transverse path.

6. Signature stacker of claim 5, wherein said stop means comprise a tubular body (37) fastened to the ejecting device (17) and receiving a spring (41) supporting a small ball (42) projecting through a cross member (38) in order to engage within a cavity (43) provided in a carriage hingedly connected to base (40) of the ejecting device (17), said ball (42) being provided with a shank (44) projecting from said tubular body (37) and engaging a lever (45) acting on means (47) adapted to stop the operation of the stacker machine when said small ball (42) is out of said cavity (43).

7. Signature stacker of claim 2, wherein control means (50,52) are provided to control the speed of said moving means (8) in response to the position of a plane (48) pressed by the signatures fed upstream of said platform (7), increasing or decreasing such speed according to the higher or lower pressure of the signatures on the plane (48).

8. Signature stacker of claim 7, wherein said plane (48) is connected to a lever (50) provided with a chute (52) in contact with a sensor (53) which senses the different lever positions in function of the different pressure of the signatures on said plane (48), increasing or decreasing accordingly the speed of such moving means (8).

* * * * *